US005435781A

United States Patent [19]

Kitchens

[11] Patent Number: 5,435,781

[45] Date of Patent: Jul. 25, 1995

[54] REGISTER WITH MULTIPLE CONTROLS

[76] Inventor: Richard A. Kitchens, 1617 S. Highway 85, Fayetteville, Ga. 30214

[21] Appl. No.: 140,852

[22] Filed: Oct. 25, 1993

[51] Int. Cl.[6] ..... F24F 13/12

[52] U.S. Cl. ..... 454/284; 454/316; 454/324

[58] Field of Search ..... 454/274, 284, 290, 309, 454/311, 316, 324, 334, 347, 361

[56] References Cited

U.S. PATENT DOCUMENTS

| | | | |
|---|---|---|---|
| 964,146 | 7/1910 | Clark | 454/284 |
| 2,470,375 | 5/1949 | Schwartzberg | 454/274 |
| 3,830,146 | 8/1974 | Kaiser | 454/334 X |
| 5,188,561 | 2/1993 | Nissimoff et al. | 454/316 X |

FOREIGN PATENT DOCUMENTS

| | | | |
|---|---|---|---|
| 46943 | 4/1981 | Japan | 454/284 |

*Primary Examiner*—Harold Joyce
*Attorney, Agent, or Firm*—James B. Middleton

[57] ABSTRACT

A register for controlling air flow to or-from a vent has a front with a grille for allowing full air flow. Plates within the register are movable over the vent opening to affect the air flow. The plates may include a louver to redirect the air flow, and an imperforate plate to diminish or stop air flow. Studs on the plates extend through the front member and receive knobs for controlling the movement of the plates. A register with only the imperforate plate can be used over the return vent.

4 Claims, 1 Drawing Sheet

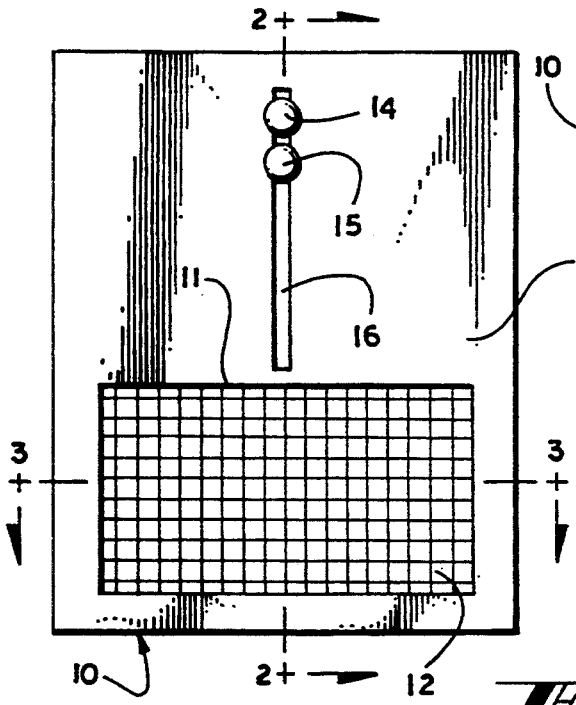
Fig_1
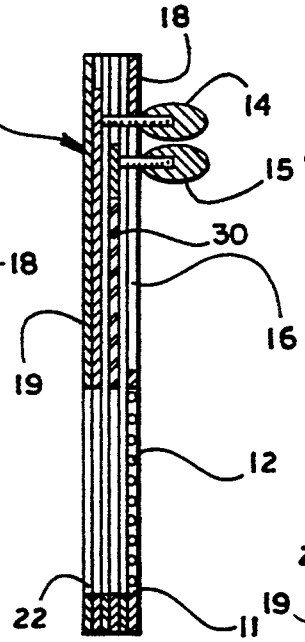
Fig_2
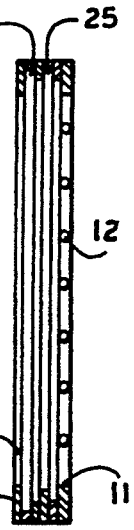
Fig_3
Fig_4
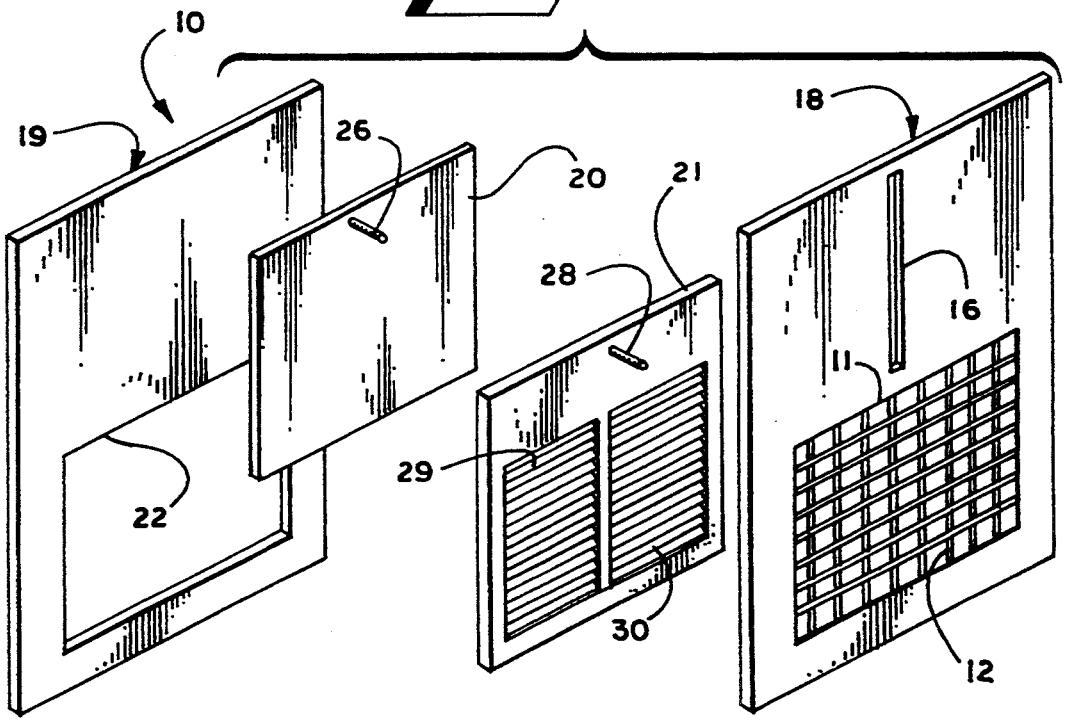

REGISTER WITH MULTIPLE CONTROLS

BACKGROUND OF THE INVENTION

1. Field of the Invention

This invention relates generally to air flow controls, and is more particularly concerned with a register having at least one plate movable into the air stream.

2. Discussion of the Prior Art

Registers are well known in the art, and many air control systems, whether for heating, cooling or ventilating, include some form of register covering the supply vents to allow selective reduction of air flow from the vent.

One of the most common registers presently includes a movable louver. The louver can be partially closed to reduce the air flow, or can be fully opened to allow full air flow. It will be understood, of course, that movement of the louvers to reduce air flow also redirects air flow because the vanes of the louver are angularly related to the air stream. Furthermore, the usual residential register has louvers that in fact will not fully close. The result is that there is always some air flow through the register.

Another form of register that has been used in residential construction includes a pivotal plate that can be selectively moved towards the grille of the register to reduce air flow. Those skilled in the art will realize that such an arrangement can be noisy, and inefficient in allowing small air flow. In addition, such registers typically do not allow the air flow to be completely stopped.

The prior art has therefore not provided a satisfactory register to allow full control of the air supply to and from a vent.

SUMMARY OF THE INVENTION

The present invention provides a register having at least one plate selectively movable into the air stream from a vent. There may be a plurality of plates; and, each plate of the plurality of plates will have different characteristics for affecting the air flow.

In one embodiment of the invention, the register has a first plate comprising at least one louver for redirecting air flow, and a second plate comprising an imperforate plate for reducing or stopping air flow. Since the plates slide into the air stream, it will be understood that the plate can be partially or fully slid into the air stream to affect only a part of the air stream, or the entire air stream at the particular vent.

It is contemplated that the register of the present invention will include a grille over the vent, and control knobs adjacent thereto for allowing selective movement of the plates.

BRIEF DESCRIPTION OF THE DRAWINGS

These and other features and advantages of the present invention will become apparent from consideration of the following specification when taken in conjunction with the accompanying drawings, in which:

FIG. 1 is a front elevational view showing a register made in accordance with the present invention;

FIG. 2 is a cross-sectional view taken along the line 2—2 in FIG. 1;

FIG. 3 is a cross-sectional view taken along the line 3—3 in FIG. 1; and,

FIG. 4 is an exploded perspective view illustrating the major pieces of the register shown in FIGS. 1–3.

DETAILED DESCRIPTION OF THE EMBODIMENT

Referring now more particularly to the drawings, and to that embodiment of the invention here presented by way of illustration, FIG. 1 shows a register generally designated at 10 having an opening 11 covered by a grille 12. It should be understood that the opening 11 will be placed over a vent connected to a duct or the like.

Above the opening 11, there are two control knobs designated at 14 and 15, the knobs 14 and 15 being placed along a slit 16. As will be discussed in detail below, the knobs 14 and 15 are connected to movable plates for selectively disposing the plates in the air stream.

Turning now to FIGS. 2 and 4, it can be seen that the register 10 includes a front member 18 and a back member 19, with two plates 20 and 21 therebetween. The opening 11 is defined in the front member 18; and, the back member 19 has an opening 22 that is aligned with the opening 11 when the front and back members are juxtaposed.

With attention to FIGS. 2 and 3, the plates 20 and 21 are received within channels 24 and 25 so the plates 20 and 21 are slidable relative to the front and rear members 18 and 19. Due to the construction, it will be recognized that the two plates 20 and 21 are slidable independently of each other, so that one or both plates can be disposed in the air stream as desired.

To control the movement of the plates 20 and 21, each of the plates has a stud extending therefrom, the studs being designated at 26 and 28. The studs 26 and 28 extend through the slit 16 as is best shown in FIG. 2. Since the plate 21 is in front of the plate 20, the stud 28 is below the stud 26. As a result, the plate 21 must be lowered before the plate 20 can be lowered.

Each of the studs 26 and 28 receives a knob, such as the knobs 14 and 15. The knobs 14 and 15 have threaded openings for threaded engagement with the studs 26 and 28. Thus, the knobs 14 and 15 can be screwed tightly against the front member 18, and the plates 20 and 21 will be held against movement. When the plate 21 is to be moved, the knob 15 can be loosened, and the knob slid down to the extent desired. The knob 15 can be retightened to hold the plate 21 in any desired location. The knob 14 similarly controls the plate 20.

As here shown by way of illustration, the plate 21 includes an opening 29 having louvers 30 therein. It is contemplated that the louvers 30 will be fixed louvers for redirecting the air stream. While the illustration shows louvers to direct the air down, it will be understood that the louvers may be of any desired design, several designs of fixed louvers being well known in the art.

In using the plate 21 to affect the air flow, it will be recognized that the plate can be moved into the air stream to only a small extent, so most of the air will move in a generally straight path, while a small portion of the air will be deflected by the louvers 30. As desired, the plate 21 can be moved further into the air stream to deflect a greater portion, even to the extent of deflecting the entire air stream.

The plate 20 is an imperforate plate for diminishing or stopping the air flow. It should be noticed that the plate 20 is substantially against the rear member 19, so any air flow between the rear member 19 and the plate 20 will be minimal. If desired, of course, seals can be placed around the opening 22, or the plate 20 can have its rear surface covered with felt or other sealing material.

In view of the construction of the register, the plate 20 can be moved somewhat for partially covering the opening 22 to diminish the air flow, or the plate 20 can completely cover the opening 22 to stop air flow. Though the plate 21 must be lowered in order to lower the plate 20, the plate 21 will not adversely affect the control because the plate 20 blocks air flow. If the louver 30 is not desired, but one wishes to diminish the air flow, both plates 20 and 21 can be lowered to the extent desired. The plates 20 and 21 will be generally overlapped, so the air will not flow through the louvers 30.

From the foregoing discussion, it will be realized that the present invention provides a register that is variable to suit individual needs. The air stream can be allowed to flow straight from the vent with substantially no obstruction for highly efficient air flow. If desired, the louver can be placed over the vent to redirect part or all of the air stream; and, if desired, the air stream can be diminished, or completely cut off. All these Variations are possible by manipulating the knobs provided on the front of the register, without the need for tools.

Further, it should be recognized that the device of the present invention can be made with only one plate. For example, the above discussion concerns mostly the supply vent of an air flow system, but a register can also be placed over the return vent. It will be understood that air flow in a room cannot be truly cut off unless both supply and return vents are blocked. Thus, one can use the present register on the return vents, with only the imperforate plate for controlling the volume of air flow. With such an arrangement, the supply and return vents can be completely cut off when desired.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A register for controlling the flow of a stream of air from a vent, said register comprising a plurality of plates selectively slidable transversely into the stream of air for affecting the stream of air, a first plate of said plurality of plates being imperforate for at least partially blocking the stream of air, a second plate of said plurality of plates including a fixed louver for redirecting the air stream, said register further including a front member defining an opening therein for allowing the stream of air to pass therethrough, and a grille coextensive With said opening, said plates lying in parallel planes parallel to the plane of said grille said first plate of said plurality of plates being adjacent to said front member, and first control means for selectively sliding said first plate with respect to said front member.

2. A register as claimed in claim 1, wherein said second plate of said plurality of plates is adjacent to said first plate, and including second control means for selectively moving said second plate with respect to said front member.

3. A register for controlling the flow of a stream of air from a vent, said register comprising a plurality of plates selectively slidable transversely into the stream of air for affecting the stream of air, a first plate of said plurality of plates being imperforate for at least partially blocking the stream of air, said register further including a front member defining an opening therein for allowing the stream of air to pass therethrough, and a grille coextensive with said opening, said plurality of plates lying in parallel planes parallel to the plane of said grille said first plate of said plurality of plates being adjacent to said front member, and first control means for selectively sliding said first plate with respect to said front member, wherein a second plate of said plurality of plates is adjacent to said first plate, and including second control means for selectively sliding said second plate with respect to said front member, said first control means including a stud extending from said first plate through a slot in said front member, and said second control means including a stud extending from said second plate and through said slot in said front member.

4. A register for controlling the flow of a stream of air from a vent, said register comprising a plurality of plates selectively slidable transversely into the stream of air for affecting the stream of air, a first plate of said plurality of plates being imperforate for at least partially blocking the stream of air, said register further including a front member defining an opening therein for allowing the stream of air to pass therethrough, and a grille coextensive with said opening, said plurality of plates lying in parallel planes parallel to the plane of said grille said first plate of said plurality of plates being adjacent to said front member, and first control means for selectively moving said first plate with respect to said front member, wherein a second plate of said plurality of plates is adjacent to said first plate, and including second control means for selectively moving said second plate with respect to said front member, and wherein said second plate includes a fixed louver for redirecting the air stream.

* * * * *